US007837241B2

(12) United States Patent
Chung et al.

(10) Patent No.: US 7,837,241 B2
(45) Date of Patent: Nov. 23, 2010

(54) TWO POINT LOCK FOR DOORS AND WINDOWS

(75) Inventors: Stanley Chung, San Diego, CA (US); Brian Bourgoin, East Haddam, CT (US); Jeffrey M. Briggs, Madison, CT (US); Paul DeMarseilles, Bradford, CT (US)

(73) Assignee: Union Tool Exporters, Ltd., Taipei (TW)

( * ) Notice: Subject to any disclaimer, the term of this patent is extended or adjusted under 35 U.S.C. 154(b) by 46 days.

(21) Appl. No.: 12/062,391

(22) Filed: Apr. 3, 2008

(65) Prior Publication Data

US 2008/0258475 A1 Oct. 23, 2008

Related U.S. Application Data

(63) Continuation-in-part of application No. 11/737,143, filed on Apr. 19, 2007, now abandoned.

(51) Int. Cl.
*E05C 3/06* (2006.01)
*E05C 19/00* (2006.01)

(52) U.S. Cl. ..... 292/199; 292/280; 292/DIG. 46

(58) Field of Classification Search ..... 292/199, 292/280, DIG. 46
See application file for complete search history.

(56) References Cited

U.S. PATENT DOCUMENTS 1,090,305 A * 3/1914 Hoffman ..... 70/100
4,958,508 A 9/1990 Lin
5,561,994 A 10/1996 Smith et al.
5,595,409 A * 1/1997 Fier et al. ..... 292/112
D389,722 S 1/1998 Blom
5,820,170 A 10/1998 Clancy
5,951,068 A 9/1999 Strong et al.
6,264,252 B1 7/2001 Clancy
D466,787 S 12/2002 Clancy
6,502,435 B2 1/2003 Watts et al.
6,688,656 B1 2/2004 Becken
7,040,671 B2 5/2006 Liu
7,178,839 B2 * 2/2007 Tsai ..... 292/51
7,228,719 B2 * 6/2007 Alchin et al. ..... 70/84
7,255,375 B2 * 8/2007 Heid et al. ..... 292/95
7,418,845 B2 * 9/2008 Timothy ..... 70/100
2006/0130543 A1 6/2006 Alchin et al.

FOREIGN PATENT DOCUMENTS

GB 2228527 A * 8/1990

OTHER PUBLICATIONS

International Search Report and Written Opinion, 8 pages.

* cited by examiner

*Primary Examiner*—Carlos Lugo
(74) *Attorney, Agent, or Firm*—Patent Law Group LLP; David C. Hsia

(57) ABSTRACT

A two point lock includes two pivotally mounted security hooks having sliding faces that engage sliding faces of a spring-loaded mishandling pin when the mishandling pin is vertically extended and the security hooks are rotatably retracted. The mishandling pin is vertically retracted when it abuts a jamb. When the mishandling pin is vertically retracted, the sliding faces disengage so that the security hooks can rotate to lock onto a striker on the jamb. Thus, the mishandling pin prevents the security hooks from being slammed into the striker before a door or a window is fully closed.

22 Claims, 21 Drawing Sheets

TWO POINT LOCK FOR DOORS AND WINDOWS

CROSS REFERENCE TO RELATED APPLICATION

This application is a continuation-in-part of U.S. application Ser. No. 11/737,143, entitled "Two Point Lock for Doors and Windows," filed on Apr. 19, 2007, which is incorporated herein by reference.

FIELD OF INVENTION

This invention relates to locks for doors, windows, and other movable fixtures for openings.

DESCRIPTION OF RELATED ART

Locks for sliding doors and windows often use rotating security hooks to lock onto a striker on a jamb. Locks also often use a mishandling mechanism that prevents the security hooks from rotating outside of the lock and slamming into the striker when the door or window is not fully closed against the jamb.

U.S. Pat. No. 5,951,068 provides a spring-loaded pin that latches a gear used to rotate the security hooks from the lock. The spring-loaded pin releases the gear after the door closes so that the security hooks can be rotated out from the lock.

U.S. Patent Application Publication No. 2006/0130543provides a spring-loaded pin that latches one of two interconnected slides used to rotate the security hooks from the lock. The spring-loaded pin releases the slides after the door closes so that the security hooks can be rotated out from the lock.

SUMMARY

In one embodiment of the invention, a two point lock includes two pivotally mounted security hooks having sliding faces that engage opposing sliding faces of a spring-loaded mishandling pin when the mishandling pin is vertically extended and the security hooks are rotatably retracted. The mishandling pin is vertically retracted when it abuts a jamb. When the mishandling pin is vertically retracted, the sliding faces disengage so that the security hooks can rotate to lock onto a striker on the jamb. Thus, the mishandling pin prevents the security hooks from being slammed into the striker before a door or a window is fully closed.

In one embodiment of the invention, the lock further includes first and second drive rails. The first drive rail has a top rack gear engaged by an input pinion gear. The first and the second drive rails have opposing rack gears that engage common pinion gears between the drive rails. When the input pinion gear rotates, it translates the first drive rail in one direction. The common pinion gears translate the second drive rail in the opposite direction.

In one embodiment, a first projection on the first drive rail engages a first cam surface on the first security hook so that the translation of the first drive rail causes the first security hook to rotate. Similarly, a second projection on the second drive rail engages a second cam surface on the second security hook so that the translation of the second drive rail causes the second security hook to rotate.

BRIEF DESCRIPTION OF THE DRAWINGS

Use of the same reference numbers in different figures indicates similar or identical elements.

DETAILED DESCRIPTION OF THE INVENTION

Figure 1:
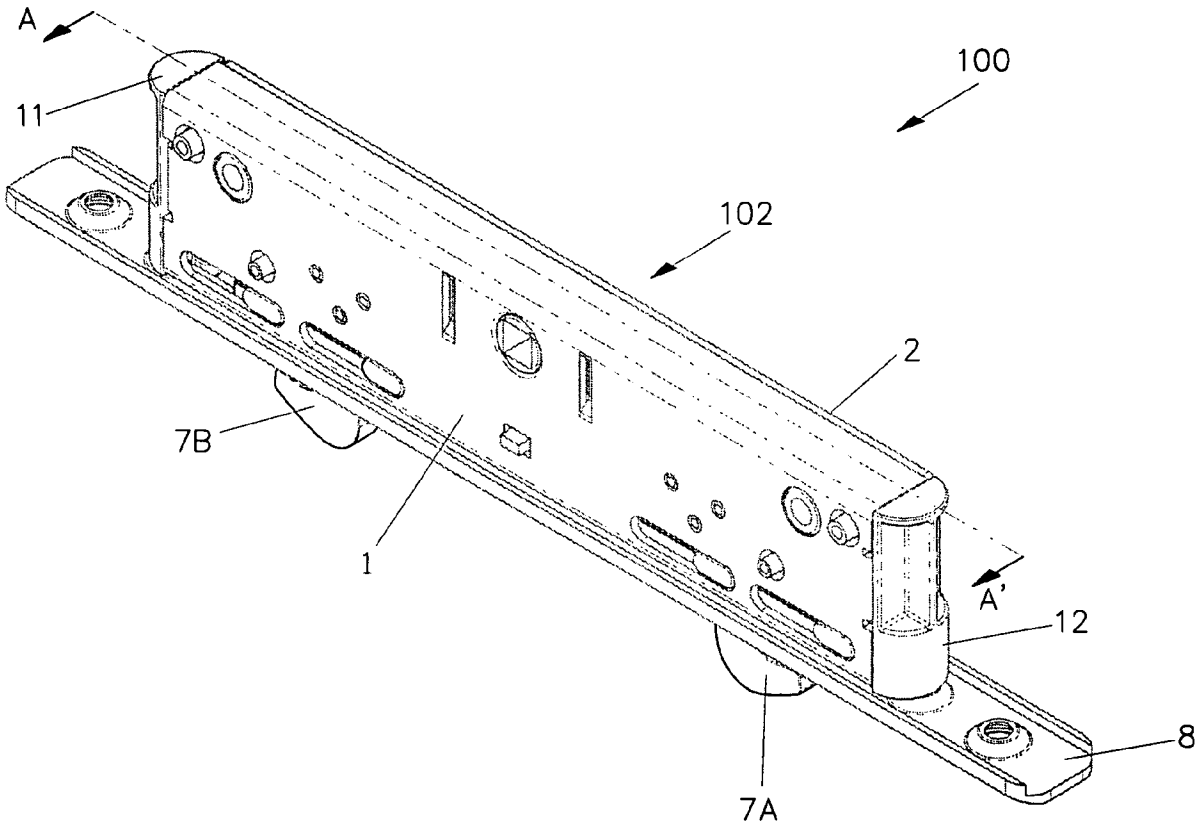
FIG. 1 is an assembled perspective view of a two point lock in one embodiment of the invention.

FIG. 1 illustrates a two point lock 100 for a movable fixture in an opening (e.g., a sliding door or a window) in one embodiment of the invention. A case 102 includes a front cover 1 and a back cover 2, and end pieces 11 and 12 that fit between covers 1 and 2 at their distal ends.

Figure 2:
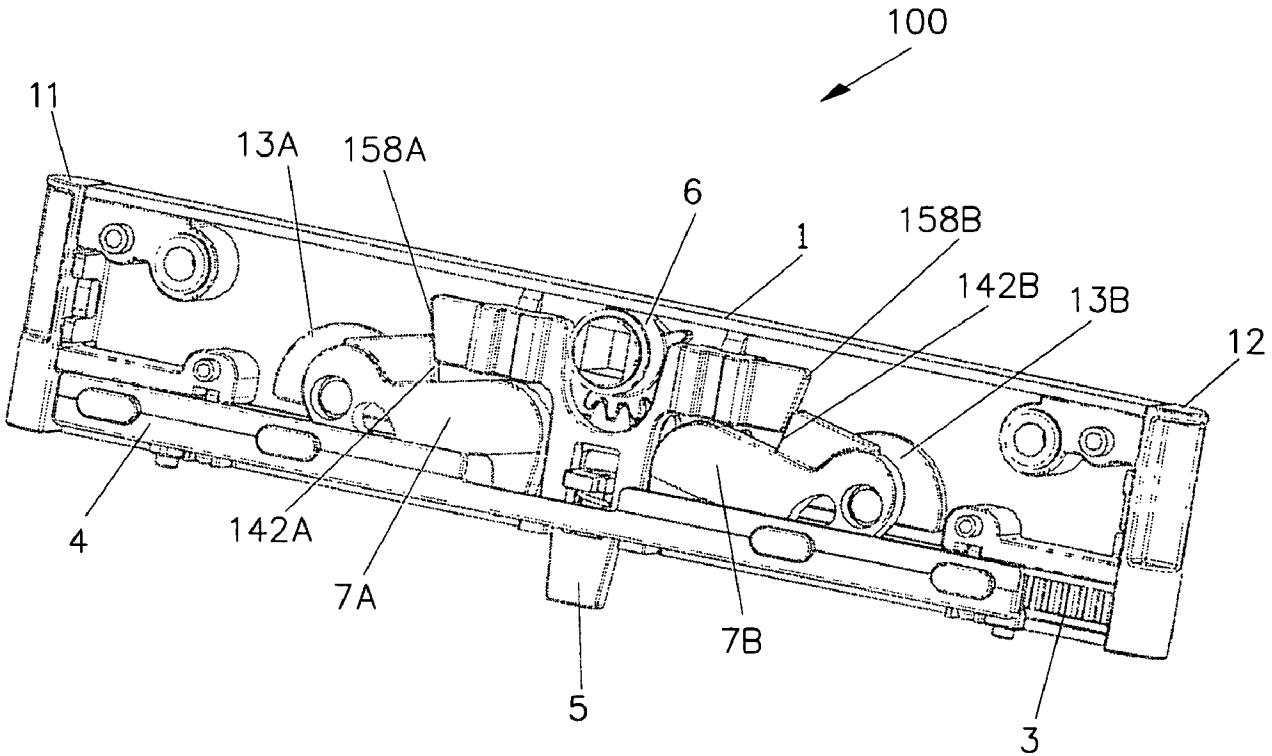
FIG. 2 is a perspective view of the two point lock of FIG. 1 less a back cover in one embodiment of the invention.
Figure 3:
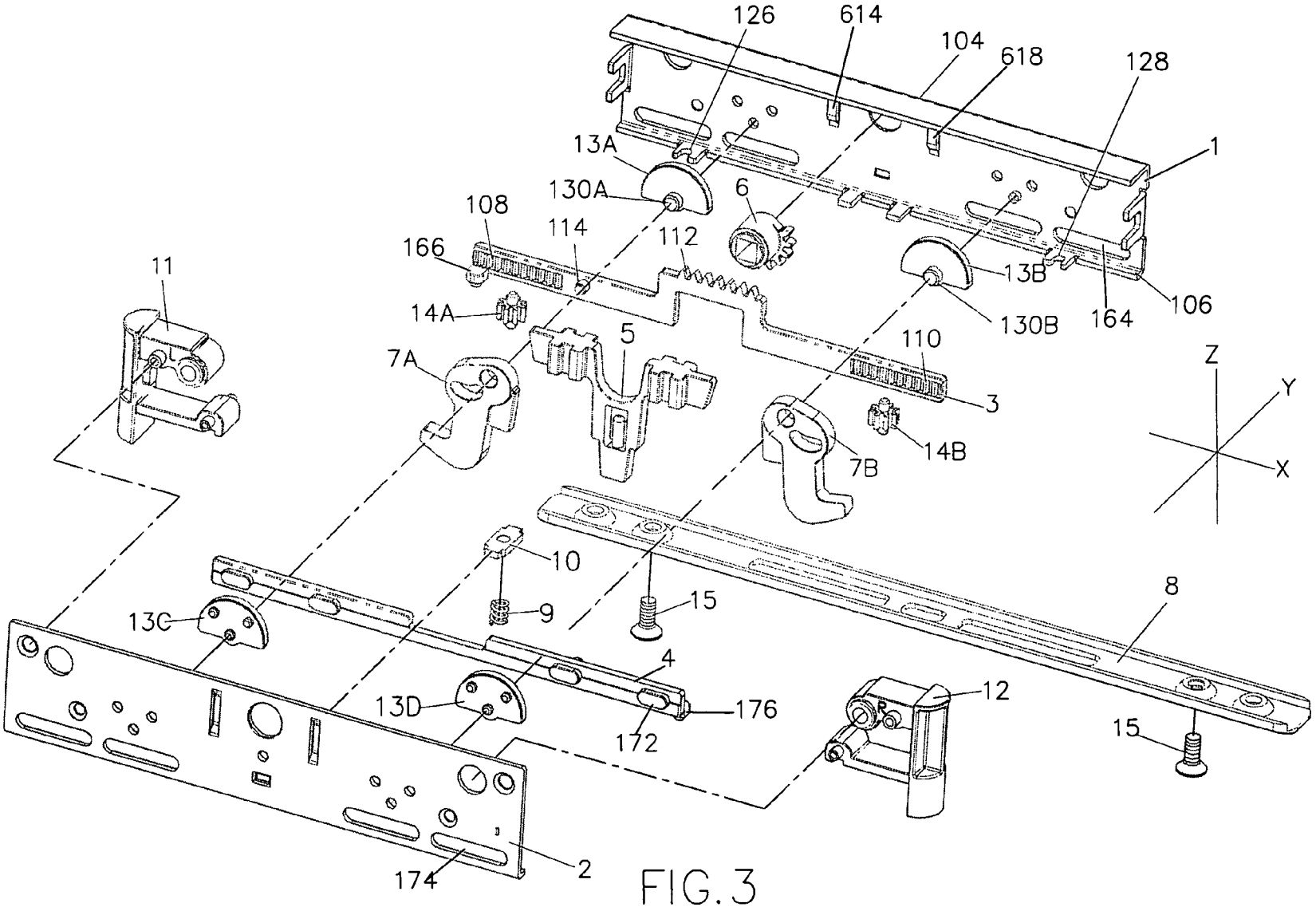
FIG. 3 is an exploded view of the two point lock of FIG. 1 in one embodiment of the invention.
Figure 4:
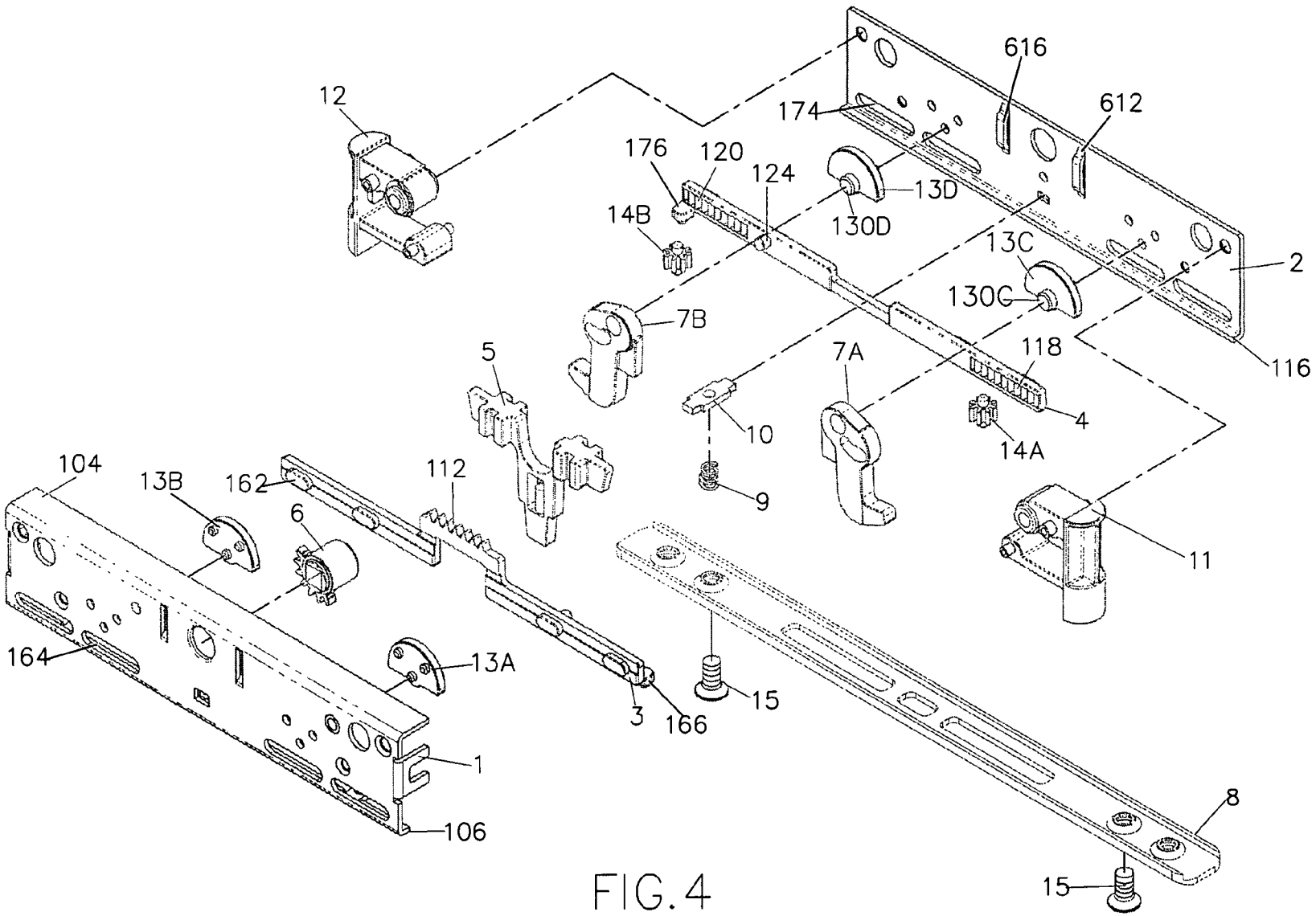
FIG. 4 is an exploded view of the two point lock of FIG. 1 from the opposite angle of FIG. 3 in one embodiment of the invention.

FIGS. 2, 3, and 4, illustrate lock 100 in more detail in one embodiment of the invention. End pieces 11 and 12 each has two horizontal arms joined by a vertical body. End pieces 11 and 12 have projections (e.g., pins and tabs) for fitting into corresponding cutouts and mounts on covers 1 and 2. Fasteners inserted into holes in covers 1 and 2 and end pieces 11 and 12 secure the components together. Fasteners 15 secure a faceplate 8 to the bottom of case 102 using holes at the bottom of end pieces 11 and 12.

Front cover 1 has a top wall 104 and a bottom wall 106. A drive rail 3 sits on bottom wall 106 to translate horizontally within case 102. Drive rail 3 has exterior projections 162 (only one is labeled in FIG. 4) that fit into slots 164 (only one is labeled) on cover 1 to guide the horizontal movement of drive rail 3. Drive rail 3 has two distal portions joined at their ends from above by a top portion. The distal portions define rack gears 108 and 110 that face the interior of case 102. The top portion defines a rack gear 112 that faces the top of case 102. Drive rail 3 has a projection 114 (e.g., a pin) adjacent to rack gear 108 that faces the interior of case 102. Drive rail 3 also has a stud 166 that can be connected to a sliding rod for driving additional locking mechanism to be described later.

Back cover 2 includes a bottom wall 116. A drive rail 4 sits on bottom wall 116 to translate horizontally within case 102. Drive rail 4 has exterior projections 172 (only one is labeled in FIG. 3) that fit into slots 174 (only one is labeled) on cover 2 to guide the horizontal movement of drive rail 4. Drive rail 4 has two distal portions joined at their ends by a mid portion. The distal portions define rack gears 118 and 120 that face the interior of case 102. Drive rail 4 has a projection 124 (e.g., a pin) adjacent to rack gear 120 that faces the interior of case 102. Drive rail 4 also has a stud 176 that can be connected to a sliding rod for driving additional locking mechanisms to be described later.

A common pinion gear 14A is mounted along the Z-direction between the lower arm of end piece 11 and a mount 126 (e.g., a U-shaped clamp) protruding from cover 1. Similarly, a common pinion gear 14B is mounted along the Z-direction between the lower arm of end piece 12 and a mount 128 (e.g., a U-shaped clamp) protruding from cover 1. Pinion gear 14A engages gear racks 108 and 118 while pinion gear 14B engages gear racks 110 and 120. Together, the rack and pinion gears translate drive rails 3 and 4 in opposite directions.

An input pinion gear 6 has protruding rims on both ends to be inserted along the Y-direction into corresponding cutouts in covers 1 and 2. When inserted between covers 1 and 2, pinion gear 6 engages rack gear 112 to translate drive rail 3 in either direction. Pinion gear 6 defines a rectangular notch to receive a snib handle used to turn pinion gear 6.

Spacers 13A and 13B have multiple exterior projections (e.g., pins) on their exterior face that fit into corresponding cutouts on cover 1. Similarly, spacers 13C and 13D have multiple exterior projections on their exterior face that fit into corresponding cutouts on cover 2. Spacers 13A, 13B, 13C, and 13D further have interior projections 130A, 130B, 130C, and 130D (e.g., pins) on their interior faces that pivotally support security hooks 7A and 7B and restrict their movement along the Y-direction within case 102.

Figure 5:
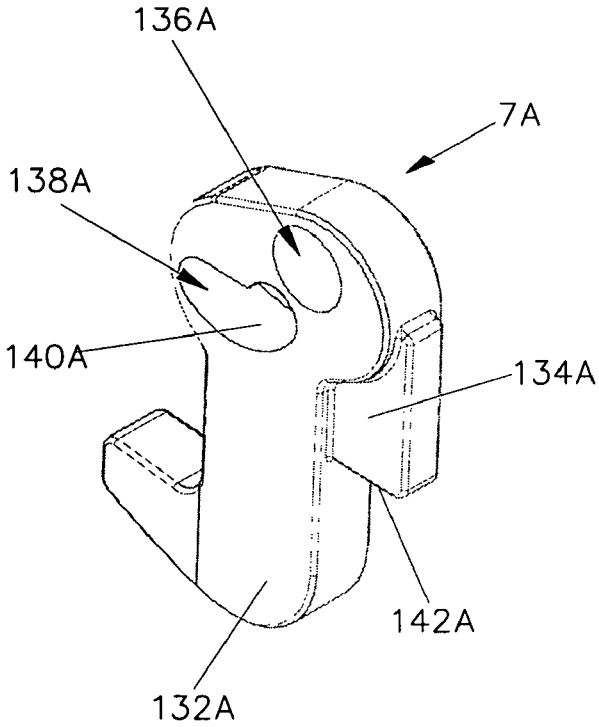
FIG. 5 is a perspective view of two security hooks of the two point lock of FIG. 1 in one embodiment of the invention.
Figure 5:
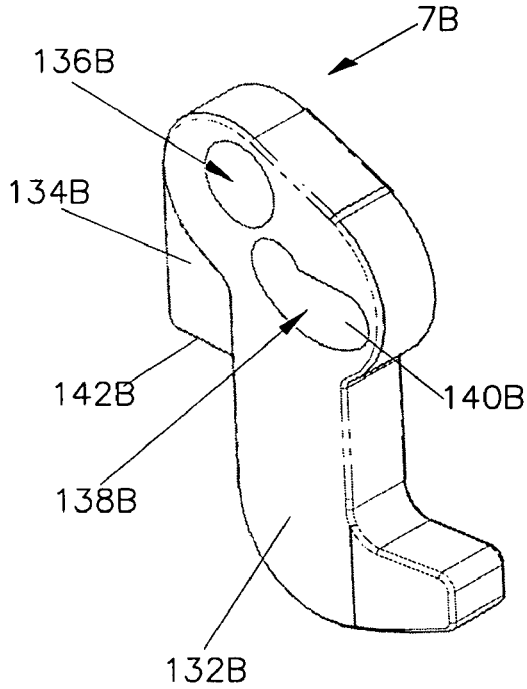

FIG. 5 illustrates the details of security hooks 7A and 7B in one embodiment of the invention. Security hook 7A includes a catch portion 132A and a latch portion 134A. Catch portion 132A is substantially a hook for locking onto a striker in a jamb. Catch portion 132A defines a hole 136A for receiving interior projections 130A and 130C of spacers 13A and 13C. Catch portion 132A further defines a guide 138A with a cam surface 140A that receives projection 114 on drive rail 3. Latch portion 134A defines an angled sliding face 142A for engaging a spring-loaded mishandling pin 5 that is described later. When security hook 7A is retracted, sliding face 142A has a negative slope along the positive X-direction.

Similarly, security hook 7B includes a catch portion 132B and a latch portion 134B. Catch portion 132B defines a hole 136B for receiving interior projections 130B and 130D of spacers 13B and 13D. Catch portion 132B further defines a guide 138B with a cam surface 140B that receives projection 124 on drive rail 4. Latch portion 134B defines an angled sliding face 142B for engaging mishandling pin 5 that is described later. When security hook 7B is retracted, sliding face 142B has a positive slope along the positive X-direction.

When drive rails 3 and 4 translate away from each other, projections 114 and 124 push against respective cam surfaces 140A and 140B and cause security hooks 7A and 7B to rotate from their retracted positions within case 102 to their extended positions outside of case 102. Vice versa, when drive rails 3 and 4 translate toward each other, projections 114 and 124 push against cam surfaces 140A and 140B and cause security hooks 7A and 7B to rotate from their extended positions outside of case 102 to their retracted positions within case 102.

Figure 6:
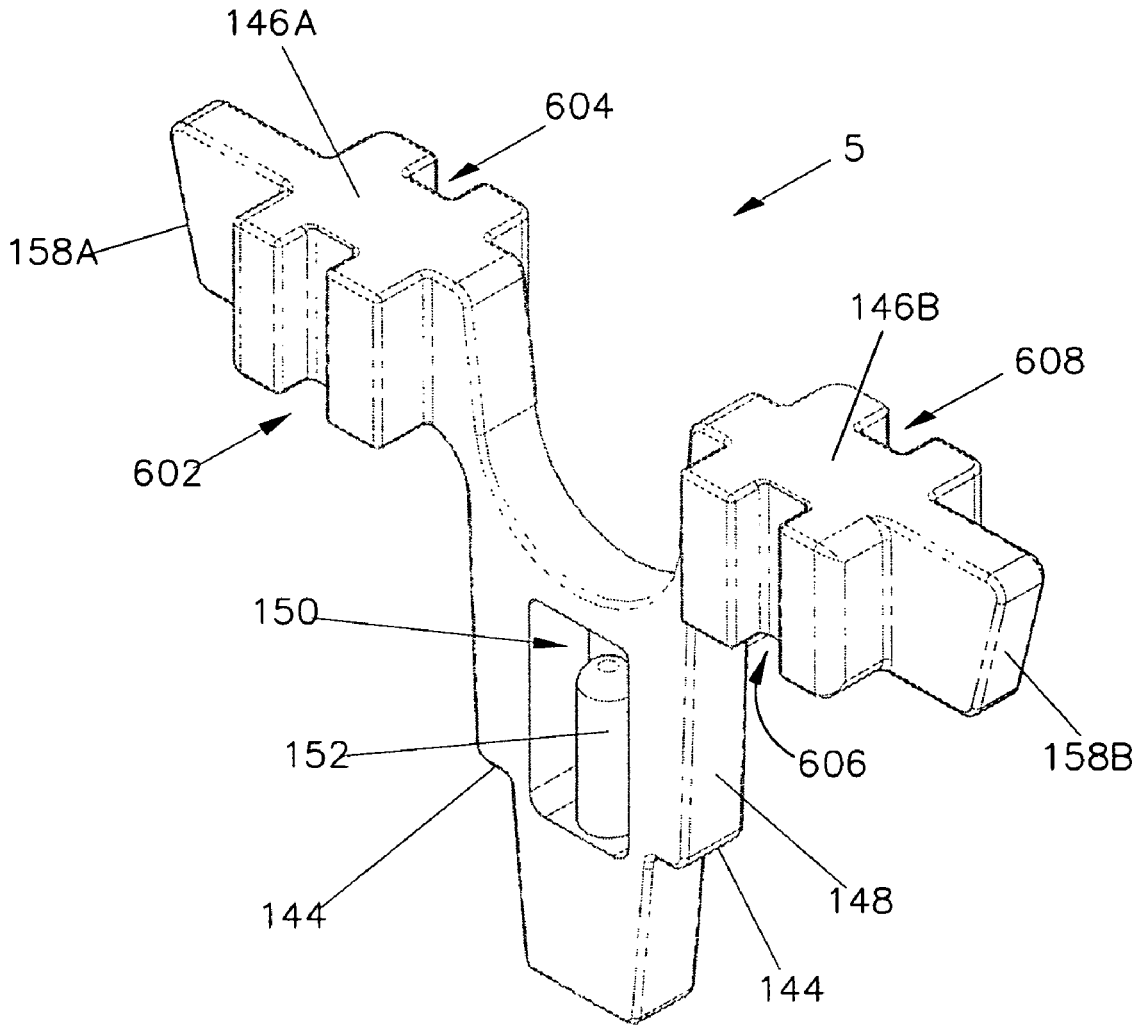
FIG. 6 is a perspective view of a mishandling pin of the two point lock of FIG. 1 in one embodiment of the invention.

FIG. 6 illustrates the details of spring-loaded mishandling pin 5 in one embodiment of the invention. Mishandling pin 5 has a substantially T-shape where two wing portions 146A and 146B are joined by a central body 148. Wing portions 146A and 146B have slots 602, 604, 606, and 608 on both sides to receive guides 612, 614, 616, and 618 (FIGS. 3 and 4) on the interior faces of covers 1 and 2 to guide the vertical movement of mishandling pin 5 within case 102. Central body 148 has shoulders 144 that abut tabs on cover 1 to limit how far mishandling pin 5 can extend.

Central body 148 defines a cavity 150 with a pin 152. A spring 9 (FIGS. 3 and 4) is placed around pin 152 so it pushes against mishandling pin 5 and a tab 10 (FIGS. 3 and 4) fixed between covers 1 and 2. Wing portions 146A and 146B are separated by a space that accommodates pinion gear 6 so that mishandling pin 5 can retract without contacting pinion gear 6.

Two outside surfaces of wing portions 146A and 146B form respective angled sliding faces 158A and 158B. Sliding face 158A has a negative slope along the positive X-direction, and sliding face 158B has a positive slope along the positive X-direction. When mishandling pin 5 is extended and security hooks 7A and 7B are retracted, sliding faces 158A and 158B engage respective sliding faces 142A and 142B. When mishandling pin is retracted (e.g., when the movable fixture abuts the jamb), sliding faces 158A and 158B disengage from sliding faces 142A and 142B.

Figure 7:
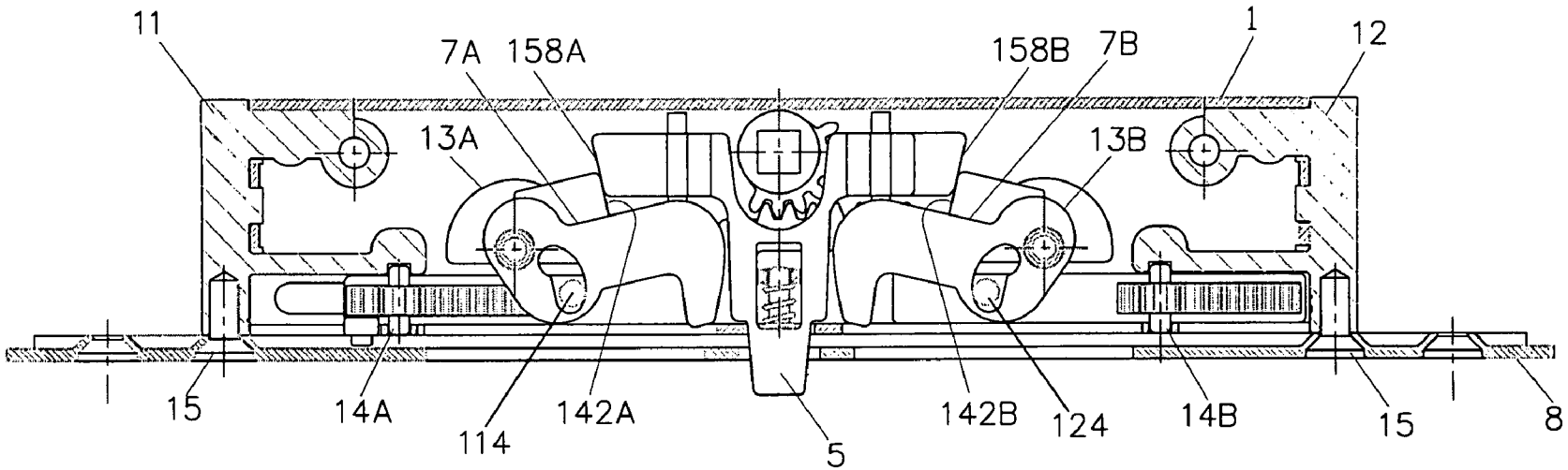
FIG. 7 is a sectional side view of the two point lock of FIG. 1 along line AA' where the mishandling pin of FIG. 6 is in its extended position and the two security hooks are in their retracted positions in one embodiment of the invention.

The operation to lock security hooks 7A and 7B onto the striker is described hereafter. FIG. 7 illustrates the state of lock 100 prior to closing the movable fixture against the jamb. As can be seen, mishandling pin 5 is extended so that its sliding faces 158A and 158B are engaged with sliding faces 142A and 142B of security hooks 7A and 7B. The contact between the sliding faces prevents security hooks 7A and 7B from rotating outside of case 102.

Figure 8:
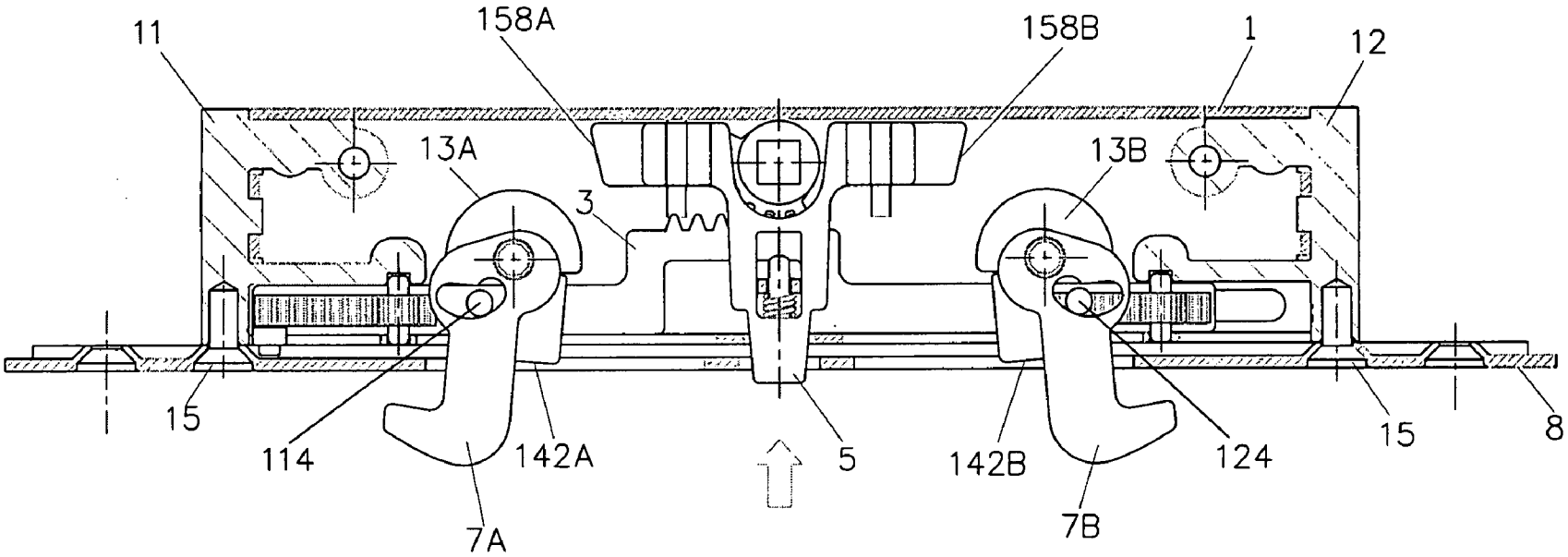
FIG. 8 is a sectional side view of the two point lock of FIG. 1 along line AA' where the mishandling pin of FIG. 6 is in its retracted position and the two security hooks are in their extended positions in one embodiment of the invention.

FIG. 8 illustrates the state of lock 100 after fully closing the movable fixture against the jamb. As the movable fixture is pulled toward the jamb, mishandling pin 5 slide vertically upward and becomes retracted. This allows sliding faces 158A and 158B of mishandling pin 5 to disengage sliding faces 142A and 142B of security hooks 7A and 7B. The substantially similar slopes of the sliding faces allow mishandling pin 5 to slide vertically upward and easily disengage from security hooks 7A and 7B. This permits security hooks 7A and 7B to rotate outside of case 102.

Referring back to FIGS. 3 and 4, the consumer rotates pinion gear 6 to extend security hooks 7A and 7B from case 102. When rotated, pinion gear 6 on rack gear 112 causes drive rail 3 to translate. When drive rail 3 translates, pinion gears 14A and 14B between rack gears 108, 110, 118, and 120 cause drive rail 4 to translate away from drive rail 3. As drive rail 3 translates, projection 114 pushes against cam surface 140A of guide 138A of security hook 7A. This causes security hook 7A to rotate outside of case 102. Similarly, as drive rail 4 translates, projection 124 pushes against cam surface 140B of guide 130B of security hook 7B. This causes security hook 7B to rotate outside of case 102 in unison with security hook 7A.

Figure 9:
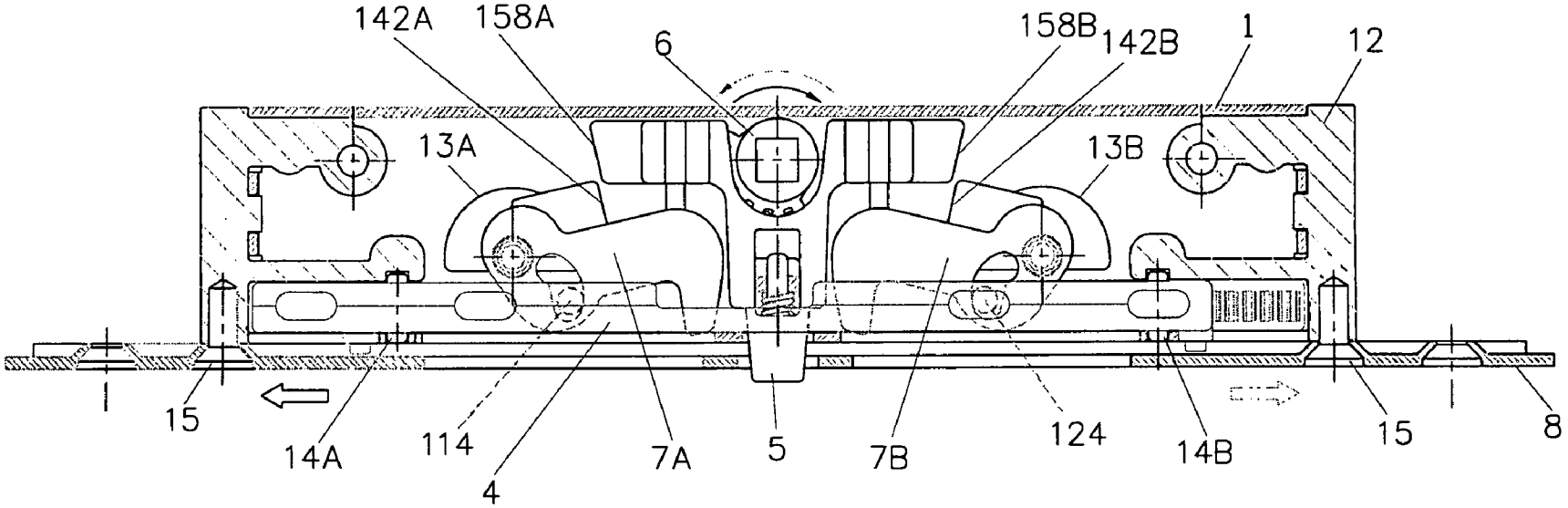
FIG. 9 is a side view of the two point lock of FIG. 1 less the back cover where the mishandling pin is in its retracted position and the two security hooks are in their retracted positions in one embodiment of the invention.

The operation to unlock security hooks 7A and 7B from the striker is described hereafter. When security hooks 7A and 7B are locked onto the striker, mishandling pin 5 is retracted so its sliding faces 158A and 158B are disengaged from sliding faces 142A and 142B of security hooks 7A and 7B. The consumer now rotates pinion gear 6 in a reverse direction to retract security hooks 7A and 7B back into case 102. FIG. 9 illustrates the state of lock 100 when security hooks 7A and 7B and mishandling pin 5 are retracted.

As the movable fixture is pulled away from the jamb, mishandling pin 5 slides vertically downward and becomes extended. As shown in FIG. 7, this causes sliding faces 158A and 158B of mishandling pin 5 to reengage sliding faces 142A and 142B of security hooks 7A and 7B. The substantially similar slopes of the sliding faces allow mishandling pin 5 to slide vertically downward and easily reengage security hooks 7A and 7B.

Figure 10:
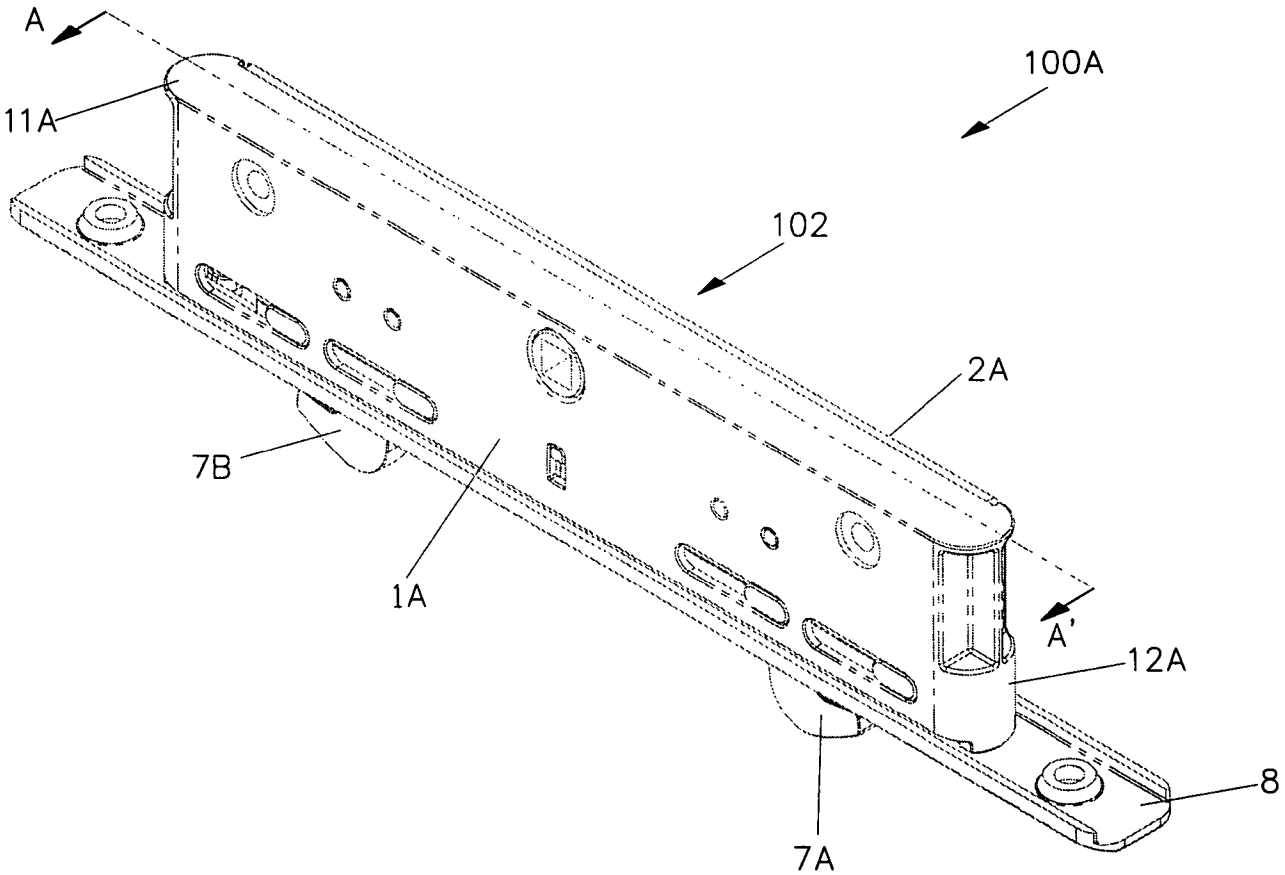
FIG. 10 is an assembled perspective view of a two point lock in another embodiment of the invention.

FIG. 10 illustrates a two point lock 100A for a movable fixture in an opening (e.g., a sliding door or a window) in another embodiment of the invention. Lock 100A is similar to lock 100 (FIG. 1) but for the following details.

Figure 11:
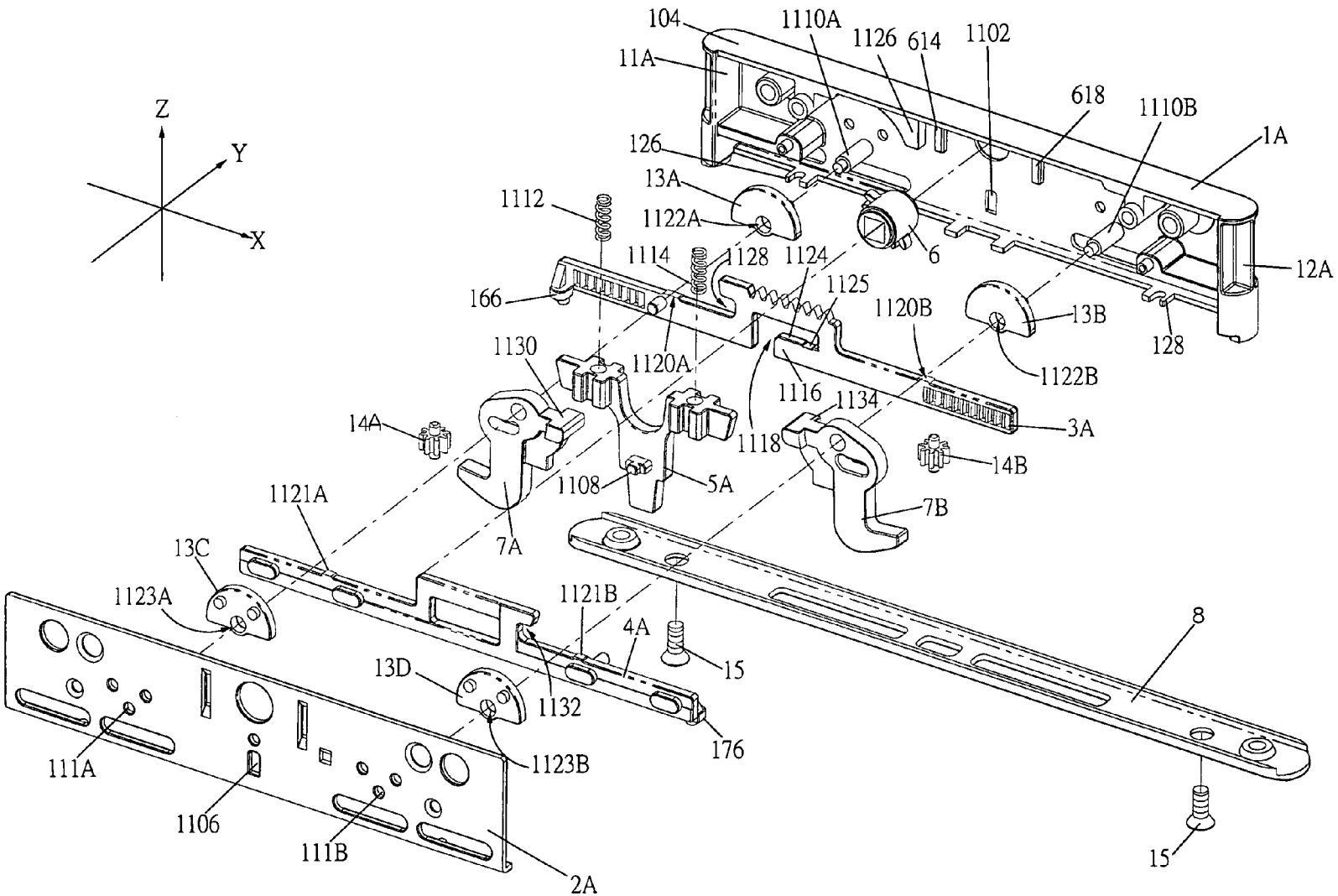
FIG. 11 is an exploded view of the two point lock of FIG. 10 in one embodiment of the invention.
Figure 12:
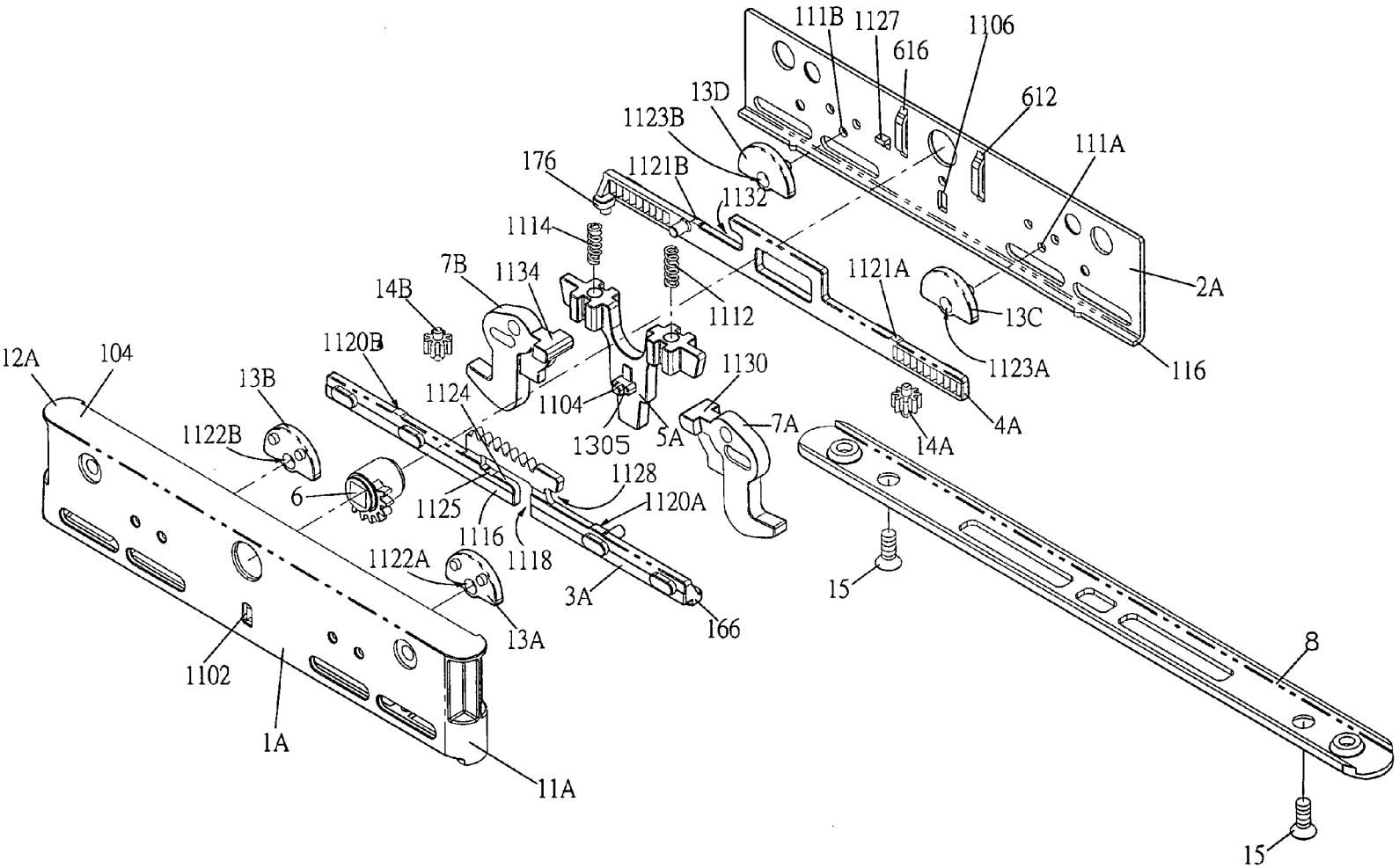
FIG. 12 is an exploded view of the two point lock of FIG. 10 from the opposite angle of FIG. 11 in one embodiment of the invention.

FIGS. 11 and 12 show that a front cover 1A is integrated with end pieces 11A and 12A to simplify construction and assembly. Front cover 1A also has a slot 1102 for receiving a tab 1104 (FIG. 12) extending from a mishandling pin 5A. Similarly, a back cover 2A has a slot 1106 for receiving a tab 1108 extending from mishandling pin 5A. Slots 1102 and 1106 and tabs 1104 and 1108, along with slots 602, 604, 606, and 608 (FIG. 13) and guides 612, 614, 616, and 618, control the vertical movement of mishandling pin 5A. Slots 1102 and 1106 also limit the vertical travel of mishandling pin 5A so it does not strike top wall 104 of front cover 1A.

Furthermore, front cover 1A has posts 1110A and 1110B that extend through spacers 13A, 13B, hooks 7A and 7B, and spacers 13C and 13D, respectively. Front cover 1A also has a guide 1126 (FIG. 11) above a drive rail 3A to prevent any vertical movement of the drive rail. Back cover 2A defines holes 111A and 111B for receiving the other ends of posts 1110A and 1110B, respectively. Back cover 2A also has a guide 1127 (FIG. 12) above a drive rail 4A to prevent any vertical movement of the drive rail. In other aspects, covers 1A and 2A are similar to covers 1 and 2 described above.

Drive rail 3A has two distal rack gear portions joined at their ends from above by a top rack gear portion. Drive rail 3A forms a feature 1128 (e.g., a notch) that matches a feature 1130 (e.g., a block) on hook 7A. After hook 7A is fully extended by drive rail 3A, block 1130 faces notch 1128. Drive rail 3A is then further translated so that notch 1128 engages block 1130 to prevent hook 7A from retracting and releasing when lock 100A is repeatedly pulled back and forth. As discussed above, guide 1126 from front cover 1A extends over the top of drive rail 3A. Guide 1126 also prevents hook 7A from retracting and releasing a strikes when lock 100A is repeatedly pulled back and forth.

One end 1116 of a distal rack gear portion extends parallel under the top rack gear portion to form an L-shaped slot 1118 for receiving a bump 1305 (FIG. 13A) of mishandling pin 5A as drive rail 3A travels horizontally and hooks 7A and 7B extends. Bump 1305 sits on a surface 1124 of slot 1118 to prevent mishandling pin 5A from extending and hitting the striker when hooks 7A and 7B are fully extended when lock 100A is locked.

Surface 1124 defines a notch 1125 that retains bump 1305 of mishandling pin 5A after drive rail 3A has reached the end of its travel and hooks 7A and 7B are fully extended. This provides a positive locking feedback to the user when lock 100A is brought into or out of the locked position. More importantly, this stops hooks 7A and 7B from coming free unless a snib handle 1202 (FIG. 12A) connected to pinion gear 6 is thrown to bring hooks 7A and 7B back into the casing.

Drive rail 3A includes bumps 1120A and 1120B along the top surface of its distal ends. The bumps slide against rounded bottom 1122A and 1122B of spacers 13A and 13B. Again, this provides a positive locking feedback and stops hooks 7A and 7B from coming free unless snib handle 1202 (FIG. 12A) connected to pinion gear 6 is thrown. In other aspects, drive rail 3A is similar to drive rail 3 described above.

Drive rail 4A includes bumps 1121A and 1121B along the top surface of its distal ends. The bumps slide against rounded bottom 1123A and 1123B of spacers 13C and 13D. Again, this provides a positive locking feedback to the user and stops hooks 7A and 7B from coming free unless the snib handle 1202 (FIG. 12A) connected to pinion gear 6 is thrown.

Drive rail 4A forms a feature 1132 (e.g., a notch) that matches a feature 1134 (e.g., a block) on hook 7B. After hook 7B is fully extended by drive rail 4A, block 1134 faces notch 1132. Drive rail 4A is then further translated so that notch 1132 engages block 1134 to prevent hook 7B from being released when lock 100A is repeatedly pulled back and forth. As discussed above, guide 1127 from back cover 2A extends over the top of drive rail 4A. Guide 1127 also prevents hook 7B from retracting and releasing the striker when lock 100A is repeatedly pulled back and forth.

In other aspects, drive rail 4A is similar to drive rail 4 described above.

Figure 13:
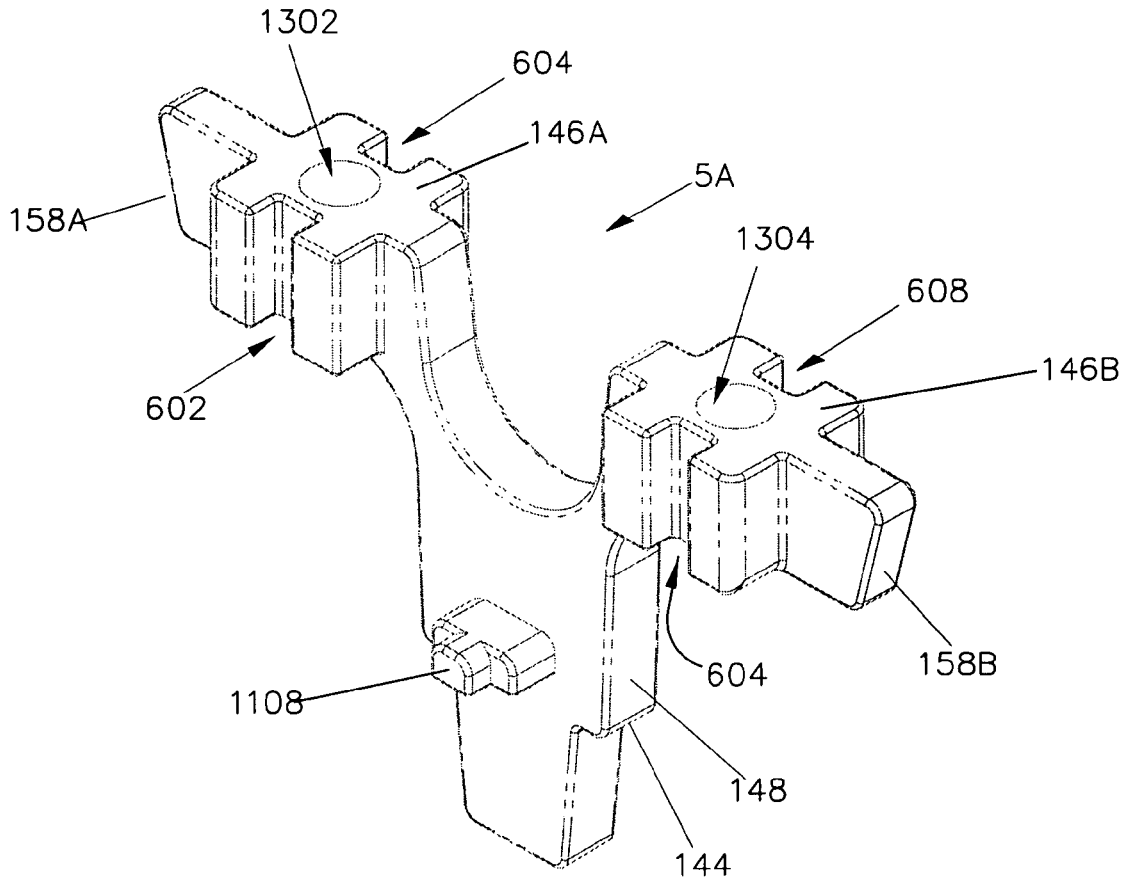
FIGS. 13 and 13A are perspective views of a mishandling pin of the two point lock of FIG. 10 in one embodiment of the invention.
Figure 13A:
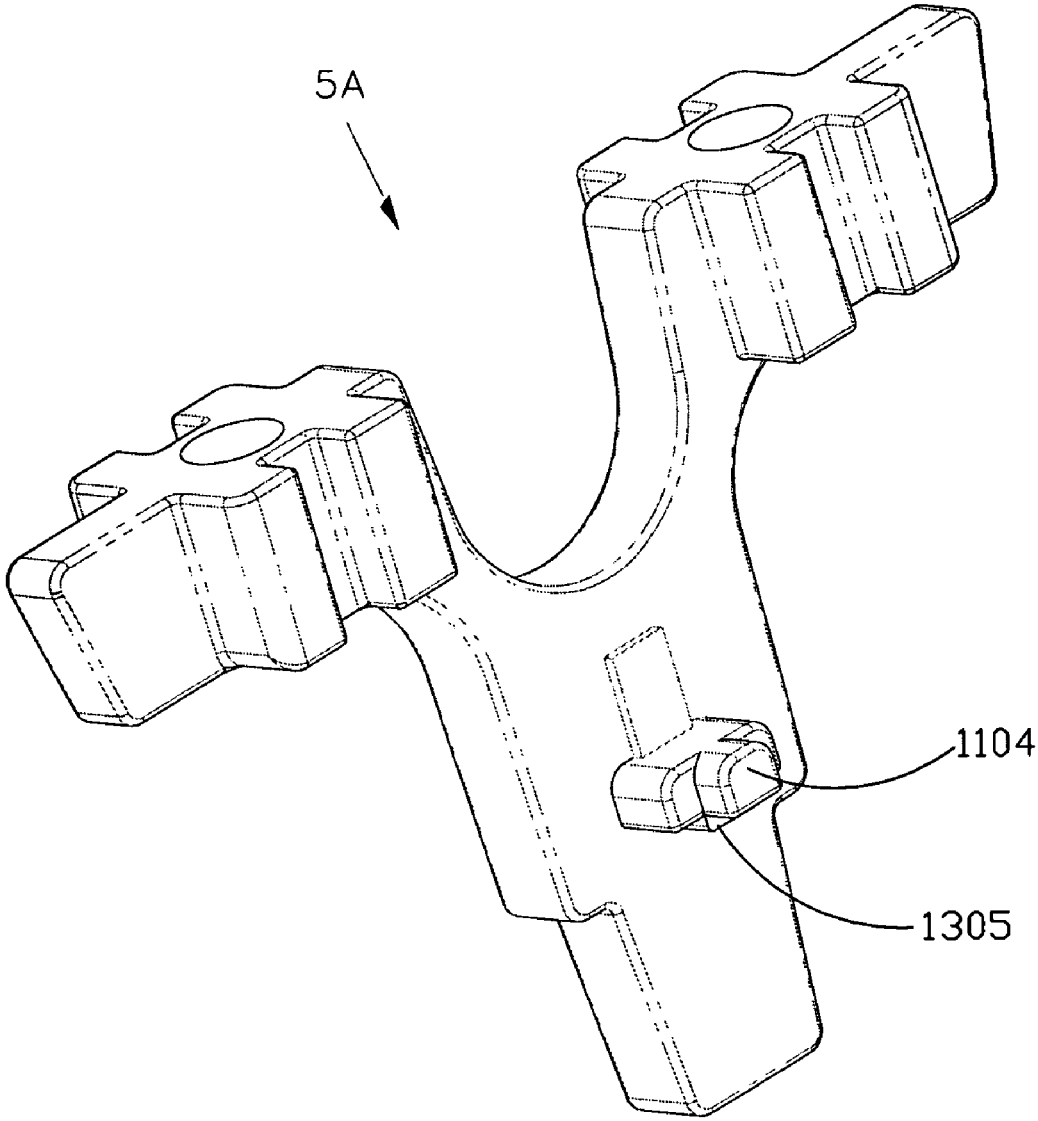

Mishandling pin 5A is spring-loaded by springs 1112 and 1114. As shown in FIG. 13, springs 1112 and 1114 sit in spring holes 1302 and 1304 in wings 146A and 146B of mishandling pin 5A, respectively. Tabs 1104 (FIG. 12) and 1108 protrude from central body 148. As shown in FIG. 13A, mishandling pin 5A includes a bump 1305 below tab 1104 that slides on surface 1124 of slot 1118 and fits into notch 1125 on surface 1124. In other aspects, mishandling pin 5A is similar to mishandling pin 5 described above.

Figure 12A:
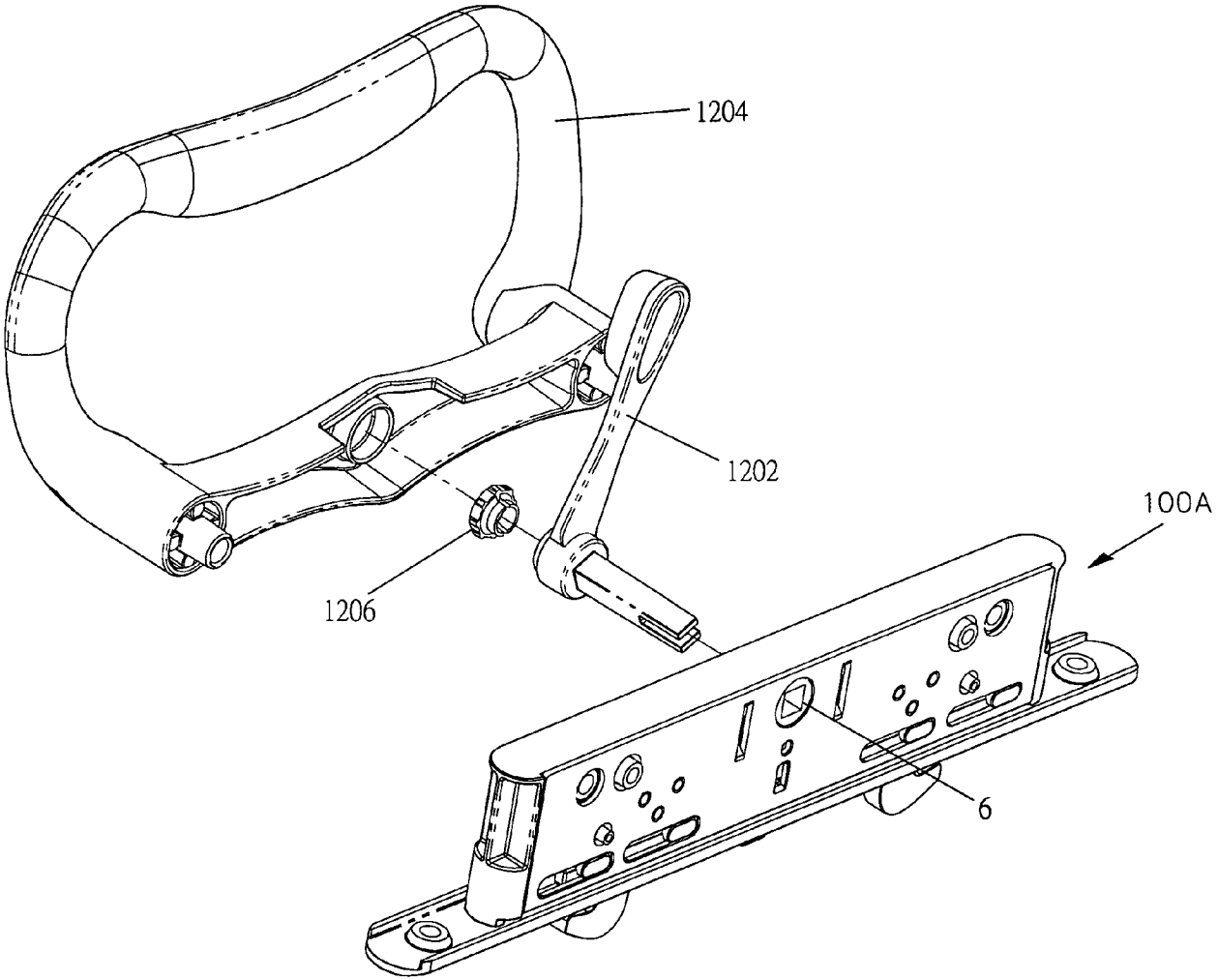
FIGS. 12A, 12B, and 12C illustrate a snib handle and a door handle mounted to the two point lock of FIG. 10 in one embodiment of the invention.
Figure 12B:
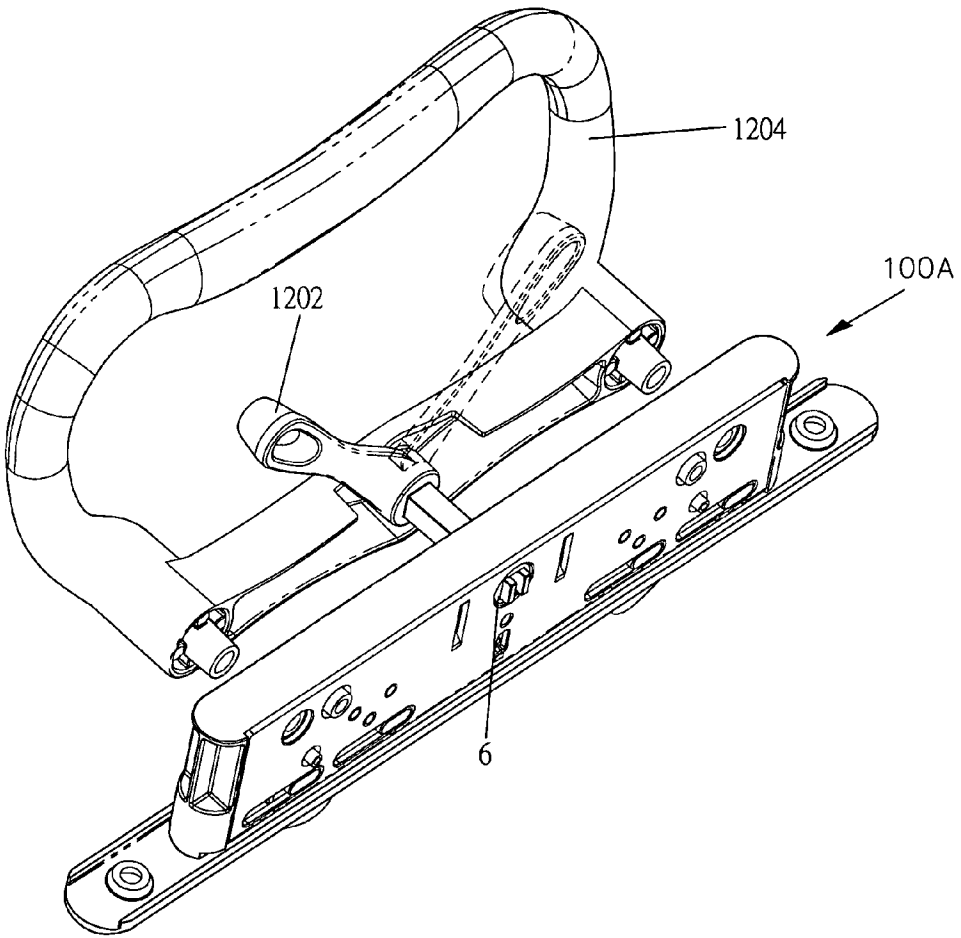
Figure 12C:
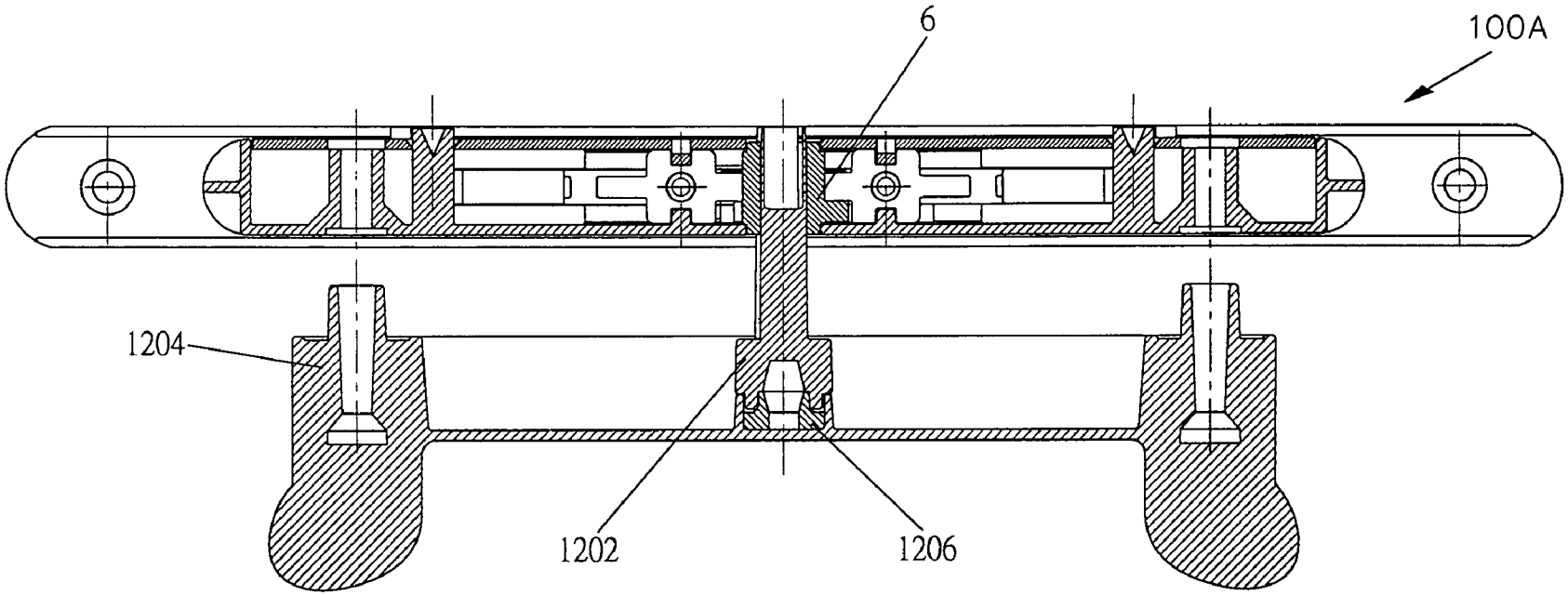

Referring to FIGS. 12A, 12B, and 12C, snib handle 1202 is inserted into pinion gear 6 of lock 100A, and then a door handle 1204 having a recessed snib washer 1206 is secured to case 102. Once door handle 1204 is secured to case 102, snib washer 1206 provides a spring force against snib handle 1202 so snib handle 1202 does not freely rotate to release hooks 7A and 7B of lock 100A from the striker when door handle 1204 is repeatedly pulled back and forth.

Figure 14:
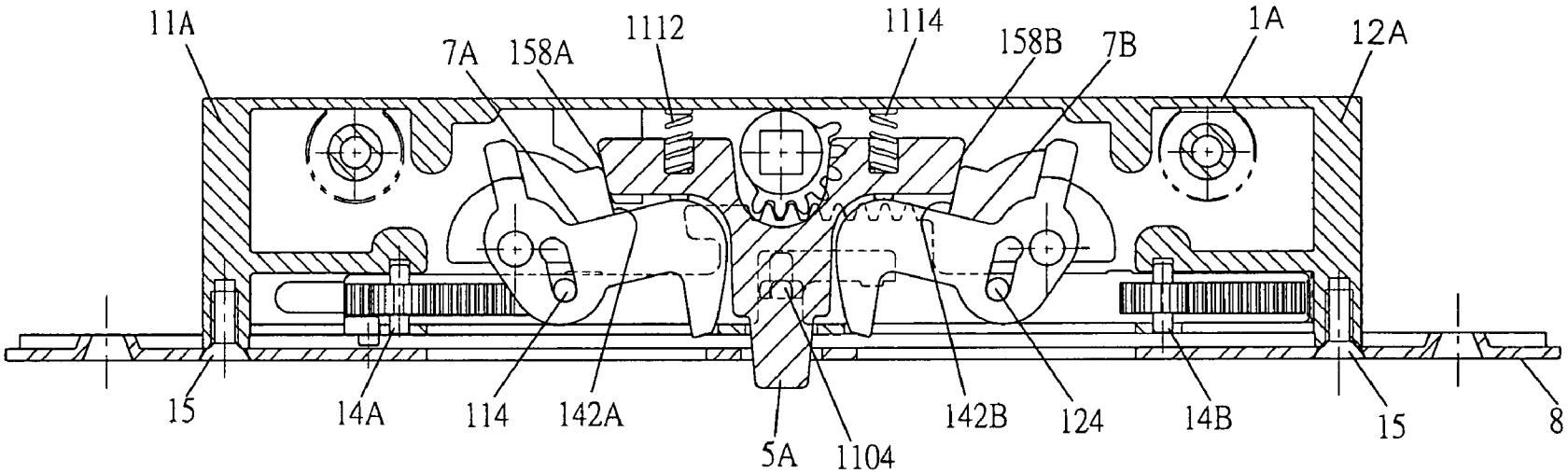
FIG. 14 is a sectional side view of the two point lock of FIG. 10 along line AA' where the mishandling pin of FIG. 13 is in its extended position and the two security hooks are in their retracted positions in one embodiment of the invention.

FIG. 14 illustrates the state of lock 100A prior to closing the movable fixture against the jamb. As can be seen, mishandling pin 5A is extended by springs 1112 and 1114 so that its sliding faces 158A and 158B are engaged with sliding faces 142A and 142B of security hooks 7A and 7B. The contact between the sliding faces prevents security hooks 7A and 7B from rotating outside of case 102.

Figure 15:
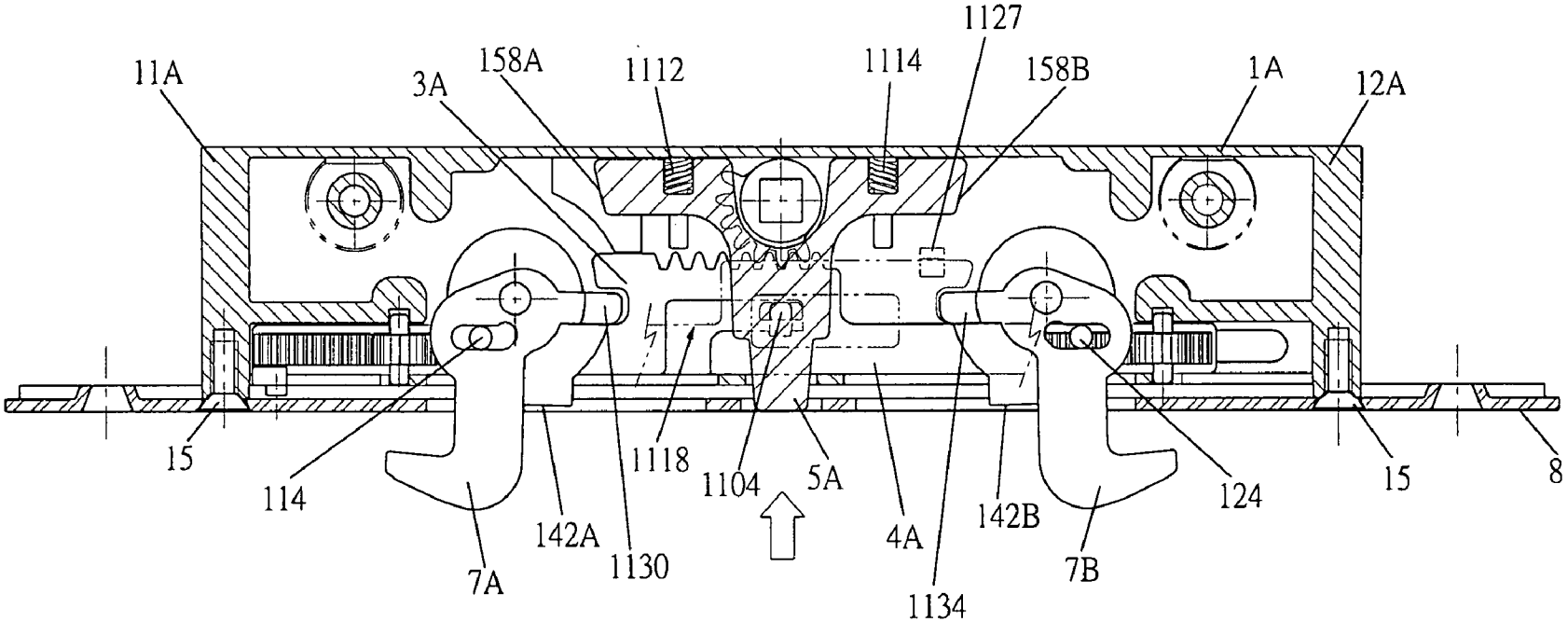
FIG. 15 is a sectional side view of the two point lock of FIG. 10 along line AA' where the mishandling pin of FIG. 13 is in its retracted position and the two security hooks are in their extended positions in one embodiment of the invention.

FIG. 15 illustrates the state of lock 100A when security hooks 7A and 7B are extended and mishandling pin 5 is retracted. Mishandling pin 5A is vertically retracted against springs 1112 and 1114 so that sliding faces 158A and 158B are disengaged from sliding faces 142A and 142B of security hooks 7A and 7B. This permits security hooks 7A and 7B to rotate outside of case 102. Note that pin 1104 is received in slot 1118 of drive rail 3A so that mishandling pin 5A cannot spring out and hit the strike when hooks 7A and 7B are fully extended. To prevent hooks 7A and 7B from releasing the strike when lock 100A is repeatedly pulled back and forth, drive rails 3A and 4A engage block 1130 and 1134 on hooks 7A and 7B, respectively, and guides 1126 and 1127 prevents vertical movement of drive rails 3A and 3B, respectively. Otherwise the operation of lock 100A is similar to the operation of lock 100 described above.

Figure 16:
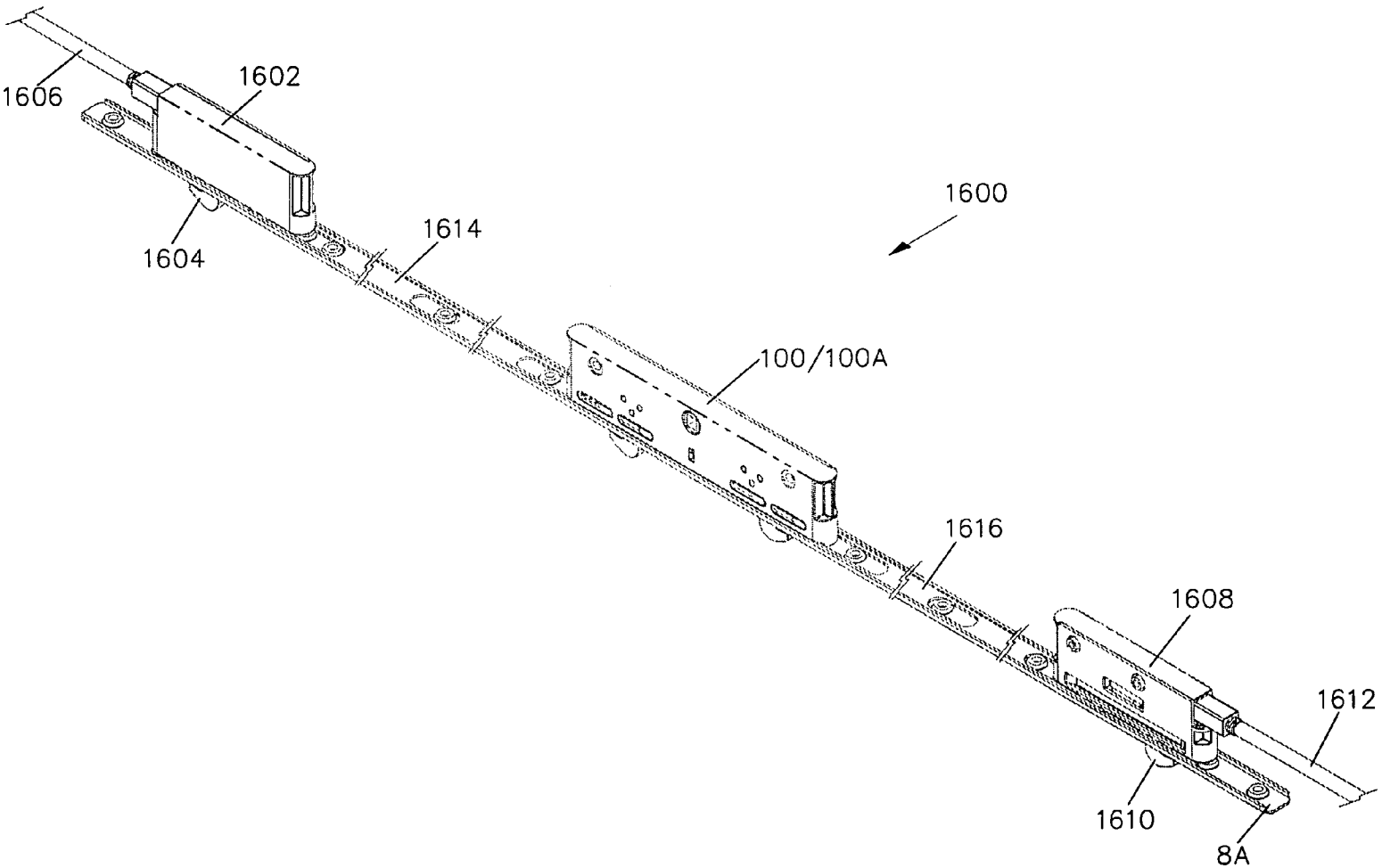
FIG. 16 is an assembled perspective view of a six point lock in one embodiment of the invention.
Figure 17:
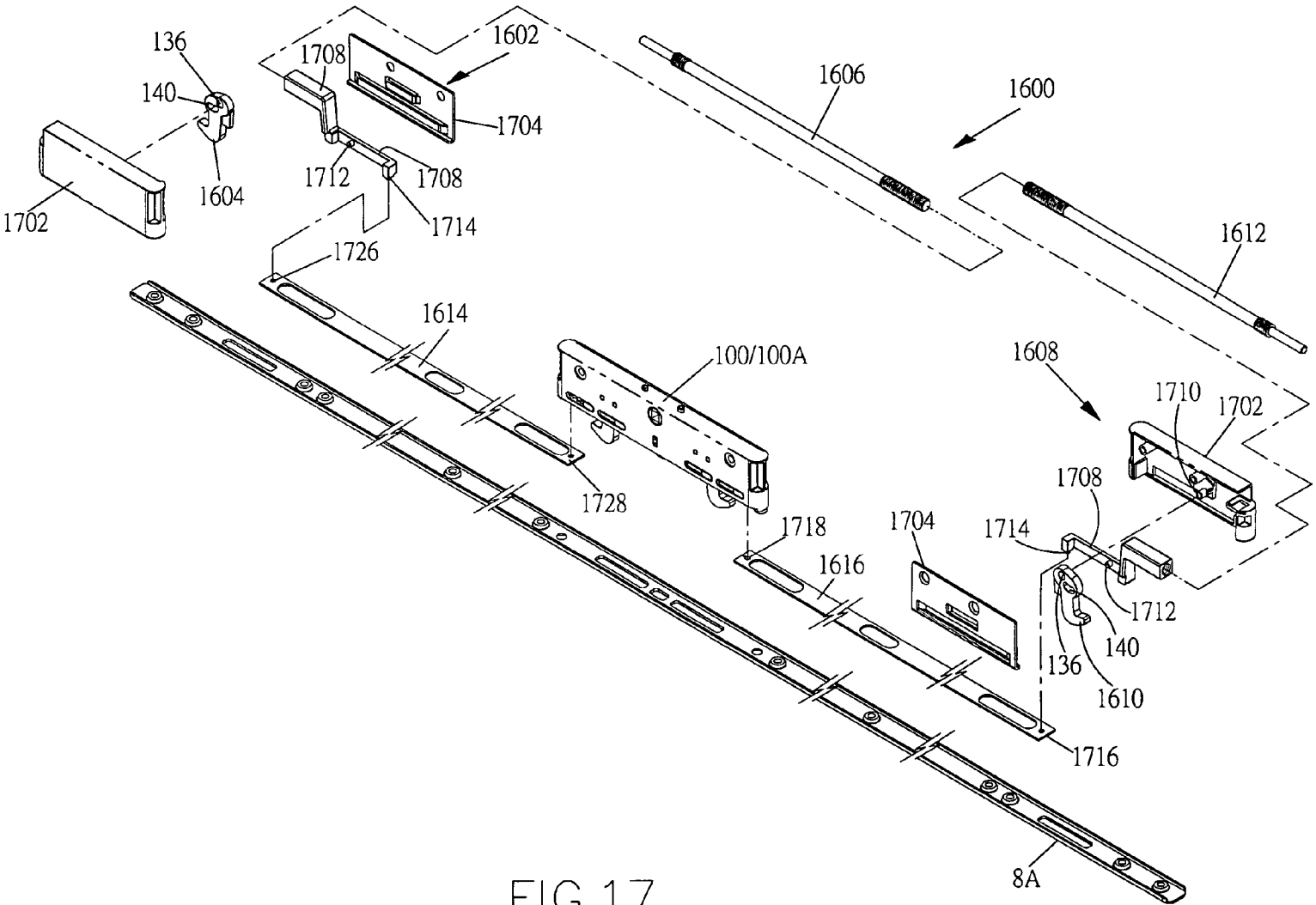
FIG. 17 is an exploded view of the six point lock of FIG. 16 in one embodiment of the invention.

FIGS. 16 and 17 illustrate a six point lock 1600 in one embodiment of the invention. Lock 1600 includes either a primary lock 100 (FIG. 1) or 100A (FIG. 10) mounted to the middle of an elongated faceplate 8A. A secondary lock 1602 is mounted to an upper end of faceplate 8A. Secondary lock 1602 includes a security hook 1604 and a shoot bolt 1606. Similarly, a secondary lock 1608 is mounted to a lower end of faceplate 8A. Secondary lock 1608 includes a security hook 1610 and a shoot bolt 1612. Secondary locks 1602 and 1608 are linked to primary lock 100/100A by respective sliding rods 1614 and 1616 slidably mounted on faceplate 8A.

Referring to FIG. 17, the details of secondary lock 1608 are described. Secondary lock 1608 includes covers 1702 and 1704 that encase security hook 1604 and a rail 1708. Security hook 1604 has a hole 136 for receiving a projection 1710 on cover 1702 so security hook 1604 can rotate. Security hook 1604 further has a cam surface 140 for engaging a pin 1712 on rail 1708 so security hook 1604 rotates when rail 1708 translates. A spring 1711 presses rail 1708 against the ceiling of cover 1702 to guide its movement. Rail 1708 has a stud 1714 for engaging a hole 1716 on one end of sliding rod 1616. Sliding rod 1616 has a hole 1718 on another end for receiving stud 176 (FIGS. 4 and 12) of primary lock 100/100A.

Secondary lock 1602 is similarly constructed as secondary lock 160. Its rail 1708 has a stud 1714 for engaging a hole 1726 on one end of sliding rod 1614. Sliding rod 1614 has a hole 1728 on another end for receiving stud 166 (FIGS. 3 and 11) of primary lock 100/100A.

When drive rails 3/3A and 4 (FIGS. 3, 4, 11, and 12) translate to activate primary lock 100/100A, their translation also causes sliding rods 1614 and 1616 to translate toward the two ends of lock 1600. The translation of sliding rods 1614 and 1616 then causes rails 1708 of secondary locks 1602 and 1608 to extend shoot bolts 1606 and 1612 into their locked positions. The translation of rails 1708 also causes security hooks 1604 and 1610 of secondary locks 1602 and 1608 to rotate into their locked positions. To retract the security hooks and the shoot bolts, the above steps are reversed.

Although a six point lock 1600 is described with secondary locks having both shoot bolts and security hooks, in some embodiments lock 1600 may be a four point lock where the secondary locks only have shoot bolts or security hooks.

Various other adaptations and combinations of features of the embodiments disclosed are within the scope of the invention.

The invention claimed is:

1. A lock, comprising:

a case;

a first security hook pivotally mounted to the case to extend from and to retract within the case, the first security hook comprising a first sliding face;

a second security hook pivotally mounted to the case to extend from and to retract within the case, the second security hook comprising a second sliding face;

a spring-loaded mishandling pin comprising third and fourth sliding faces, wherein:

the third and the fourth sliding faces engage the first and the second sliding faces, respectively, to prevent the first and the second security hooks from extending from the case when the mishandling pin is in an extended position and the first and the second security hooks are retracted; and the third and the fourth sliding faces disengage the first and the second sliding faces, respectively, to allow the first and the second security hooks to extend from the case when the mishandling pin is in a retracted position;

a first drive rail slidably mounted in the case, the first drive rail comprising:

a first rack gear on a first distal side of the first drive rail; and a second rack gear on a second distal side of the first drive rail;

a second drive rail slidably mounted in the case, the second drive rail comprising:

a third rack gear on a third distal side of the second drive rail, the third rack gear facing the first rack gear;

a fourth rack gear on a fourth distal side of the second drive rail, the fourth rack gear facing the second rack gear; and a fifth rack gear on a top portion of the second drive rail;

a first pinion gear pivotally mounted to the case, the first pinion gear engaging the first and the third rack gears to translate the first and the second drive rails in opposite directions;

a second pinion gear pivotally mounted to the case, the second pinion gear engaging the second and the fourth rack gears to translate the first and the second drive rails in the opposite directions; and a third pinion gear pivotally mounted to the case, the third pinion gear engaging the fifth rack gear to translate the second drive rail in one of two directions, thereby causing the first drive rail to translate in an opposite direction.

2. The lock of claim 1, wherein the first and the third sliding faces are angled and have substantially similar slopes, and the second and the fourth faces are angled and have substantially similar slopes.

3. The lock of claim 1, wherein:

the first and the second drive rails further comprise first and second projections, respectively;

the first security hook defines a first guide having a first cam surface, the first guide receiving the first projection so that translations of the first drive rail cause the first security hook to extend from and to retract within the case; and the second security hook defines a second guide having a second cam surface, the second guide receiving the second projection so that translations of the second drive rail cause the second security hook to extend from and to retract within the case.

4. The lock of claim 3, wherein the mishandling pin comprises:

a central body defining a cavity and a pin inside the cavity, the pin receiving a spring that pushes against the mishandling pin;

first and second wings jointed by the central body, the first wing comprising a first distal surface that forms the first sliding face, the second wing comprising a second distal surface that forms the second sliding face, the first and the second wings being separated by a space that accommodates the third pinion gear when the mishandling pin is in the retracted position, the first and the second wings defining slots that receive guides on the case for controlling a movement of the mishandling pin.

5. The lock of claim 3, wherein the mishandling pin comprises:

a central body defining a tab that fits into a slot in the case to guide a movement of the mishandling pin;

first and second wings jointed by the central body, the first wing comprising a first distal surface that forms the first sliding face, the second wing comprising a second distal surface that forms the second sliding face, the first and the second wings being separated by a space that accommodates the third pinion gear when the mishandling pin is in the retracted position, the first and the second wings defining slots that receive guides on the case for controlling the movement of the mishandling pin, the first and the second wings defining holes that receive respective springs that push against the mishandling pin.

6. The lock of claim 1, wherein:

the mishandling pin comprising a bump; and the second drive rails defines a slot for receiving the bump of the mishandling pin, the slot having a surface defining a notch for retaining the bump when the first and the second security hooks are fully extended, the bump and the notch providing positive locking feedback and resistance to movement.

7. The lock of claim 6, wherein at least one of the first and second drive rails comprises at least one bump that slides against a stationary feature to provide positive locking feedback and resistance to movement.

8. The lock of claim 1, wherein at least one of the first and the second drive rails further comprises a stud connected to a sliding rod that drives an additional lock mechanism.

9. The lock of claim 8, wherein the additional lock mechanism comprises a rail connected to the sliding rod and a shot bolt connected to the rail.

10. The lock of claim 8, wherein the additional lock mechanism comprises:

a rail connected to the sliding rod, the rail comprising a pin; and a third security hook defining a cam surface for engaging the pin so that translations of the rail cause the security hook to extend from and to retract within a cover.

11. The lock of claim 1, further comprising:

a snib handle engaging the third pinion gear; and a door handle secured to the case, the door handle comprising a snib washer that provides a spring force against the snib handle.

12. The lock of claim 3, wherein:

the first drive rail and the first security hook comprise matching features that engage each other after the first drive rail is translated to extend the first security hook from the case; and the second drive rail and the second security hook comprise matching features that engage each other after the second drive rail is translated to extend the second security hook from the case.

13. The lock of claim 12, wherein the case comprises guides above the first and the second drive rails to prevent vertical movement of the first and the second drive rails.

14. A lock, comprising:

a case;

a first drive rail slidably mounted in the case, the first drive rail comprising:

a first rack gear on a first distal side of the first drive rail;

a second rack gear on a second distal side of the first drive rail;

a first projection adjacent to the first distal side;

a first notch;

a second drive rail slidably mounted in the case opposite the first drive rail, the second drive rail comprising:

a third rack gear on a third distal side of the second drive rail, the third rack gear facing the first rack gear;

a fourth rack gear on a fourth distal side of the second drive rail, the fourth rack gear facing the second rack gear;

a second projection adjacent to the fourth distal side;

a fifth rack gear on a top portion of the second drive rail;

a second notch;

a first pinion gear pivotally mounted to the case along a first direction, the first pinion gear engaging the first and the third rack gears to translate the first and the second drive rails in opposite directions;

a second pinion gear pivotally mounted to the case along the first direction, the second pinion gear engaging the second and the fourth rack gears to translate the first and the second drive rails in the opposite directions;

a third pinion gear pivotally mounted to the case along a second direction, the third pinion gear engaging the fifth rack gear to translate the second drive rail in one of two directions, thereby causing the first drive rail to translate in an opposite direction;

a first security hook pivotally mounted to the case along the second direction, the first security hook defining a first guide with a first cam surface, the first guide receiving the first projection so that translations of the first drive rail cause the first security hook to extend from and to retract within the case, the first security hook comprising a first sliding face, the first security hook comprising a first bump that engages the first notch on the first drive rail when the first security hook is extended from the case;

a second security hook pivotally mounted to the case along the second direction, the second security hook defining a second guide with a second cam surface, the second guide receiving the second projection so that translations of the second drive rail cause the second security hook to extend from and to retract within the case, the second security hook comprising a second sliding face, the second security hook comprising a second bump that engages the second notch on the second drive rail when the second security hook is extended from the case;

a spring-loaded mishandling pin comprising:

a central body; and first and second wings jointed by the central body, the first wing comprising a third sliding face having substantially similar slope as the first sliding face of the first security hook, the second wing comprising a fourth sliding face having substantially similar slope as the second sliding face of the second security hook, the first and the second wings being separated by a space that accommodates the third pinion gear when the mishandling pin is a retracted position, the first and the second wings defining slots that receive guides on the case to control a movement of the mishandling pin;

wherein:

the third and the fourth sliding faces engage the first and the second sliding faces, respectively, to prevent the first and the second security hooks from extending from the case when the mishandling pin is in an extended position and the first and the second security hooks are retracted; and the third and the fourth sliding faces disengage the first and the second sliding faces to allow the first and the second security hooks to extend from the case when the mishandling pin is in the retracted position.

15. A method for operating a two point lock, comprising:

extending a spring-loaded mishandling pin to engage first and second sliding faces of the mishandling pin with respective third and fourth sliding faces of respective first and second security hooks, wherein the mishandling pin prevents the first and the second security hooks from rotating when the mishandling pin is in an extended position and the first and the second security hooks are in retracted positions within a case;

retracting the mishandling pin to disengage the first and the second sliding faces from the third and the fourth sliding faces of the first and the second security hooks, wherein the mishandling pin allows the first and the second security hooks to rotate and extend from the case when the mishandling pin is in a retracted position; and after said retracting the mishandling pin, rotating and extending the first and the second security hooks from the case, comprising:

rotating an input pinion gear engaged to a rack gear on top of a first drive rail to translate the first drive rail, wherein common pinion gears between rack gears on sides of the first drive rail and a second drive rail translate the first and the second drive rails in opposite directions;

engaging a first cam surface on the first security hook with a first projection on the first drive rail to cause a rotation of the first security hook from a translation of the first drive rail; and engaging a second cam surface on the second security hook with a second projection on the second drive rail to cause a rotation of the second security hook from a translation of the second drive rail.

16. The method of claim 15, further comprising:

driving an additional lock mechanism by engaging at least one of the first and the second drive rails to a sliding rod.

17. The method of claim 16, wherein the sliding rod translates a rail with a shot bolt.

18. The method of claim 16, wherein the sliding rod rotates a third security hook.

19. The method of claim 15, further comprising providing positive locking feedback and resistance to movement when the security hooks are fully extended, comprising:

providing a bump on the mishandling pin that fits into a notch on the first drive rail when the security hooks are fully extended; and providing at least one bump on at least one of the first and the second drive rails, the bump sliding against a stationary feature.

20. The method of claim 15, further comprising:

engaging a snib handle with the input pinion gear; and providing a spring force against the snib handle with a snib washer.

21. The method of claim 15, further comprising:

engaging matching features on the first drive rail and the first security hook after the first drive rail is translated to extend the first security hook from the case; and engaging matching features on the second drive rail and the second security hook after the second drive rail is translated to extend the second security hook from the case.

22. The method of claim 21, further comprising providing guides above the first and the second drive rails to prevent vertical movement of the first and the second drive rails.

* * * * *